United States Patent [19]

Grossi et al.

[11] Patent Number: 4,586,587

[45] Date of Patent: May 6, 1986

[54] ELEVATOR BRAKE CONTROL METHOD AND ARRANGEMENT

[76] Inventors: Alfredo Grossi; Ricardo Grossi, both of Montes de Oca 675, Buenos Aires, Argentina

[21] Appl. No.: 622,838

[22] Filed: Jun. 21, 1984

[30] Foreign Application Priority Data

Jun. 28, 1983 [AR] Argentina ..... 293465

[51] Int. Cl.[4] ..... B66B 1/30

[52] U.S. Cl. ..... 187/29 R

[58] Field of Search ..... 187/29, 29 R; 180/197

[56] References Cited

U.S. PATENT DOCUMENTS

| | | | |
|---|---|---|---|
| 3,779,346 | 12/1973 | Winkler | 187/29 R |
| 4,102,436 | 7/1978 | Kernick et al. | 187/29 R |
| 4,102,437 | 7/1978 | Mandel | 187/29 R |
| 4,150,734 | 4/1979 | Ohira et al. | 187/29 R |
| 4,318,456 | 3/1982 | Lowry | 187/29 R |
| 4,331,220 | 5/1982 | Husson | 187/29 R |
| 4,356,896 | 11/1982 | Tamura et al. | 187/29 R |
| 4,373,612 | 2/1983 | Caputo et al. | 187/29 R |
| 4,456,096 | 6/1984 | Kajiyama | 187/29 R |

*Primary Examiner*—William M. Shoop, Jr.
*Assistant Examiner*—Shik Luen Paul Ip
*Attorney, Agent, or Firm*—Cooper, Dunham, Clark, Griffin & Moran

[57] ABSTRACT

The present invention controls the braking of an elevator by reversing its driver motor. The real time speed of the elevator is compared with a theoretical value to generate a signal for controlling the braking power of the motor. The theoretical value is determined exclusively from a preset table on the basis of the remaining distance to the floor level. The remaining distance and real time speed data is obtained from a single transducer consisting of a perforated disc coupled to the motor shaft and an optoelectronic circuit which emits a pulse for each certain distance travelled by the elevator.

9 Claims, 10 Drawing Figures

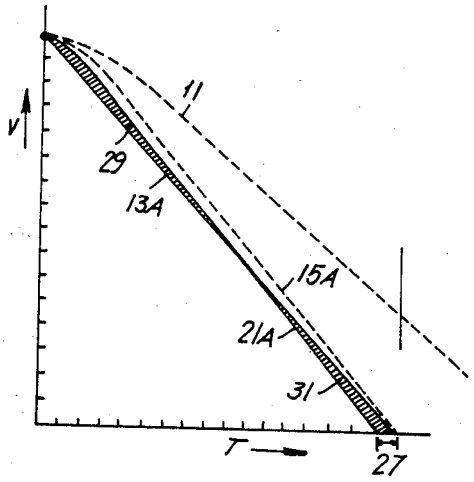
FIG. 1
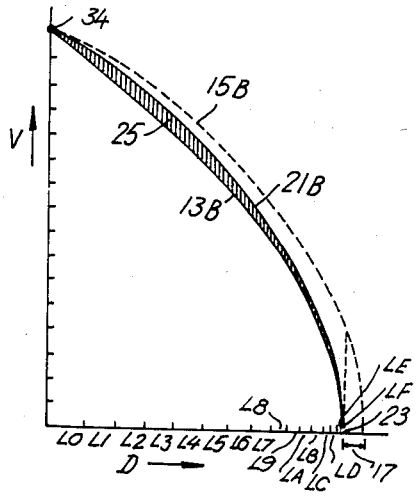
FIG. 2
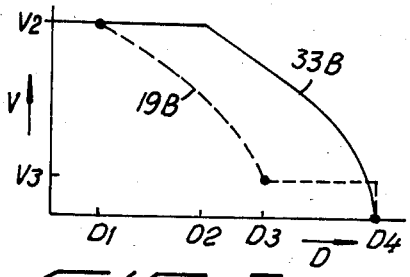
FIG. 3
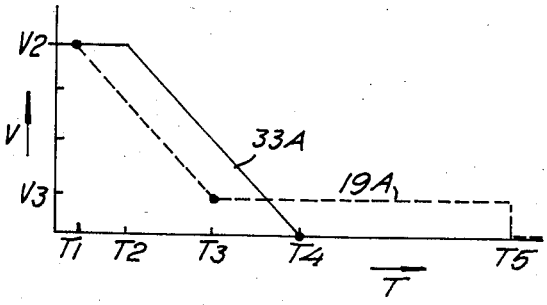
FIG. 4
FIG. 5
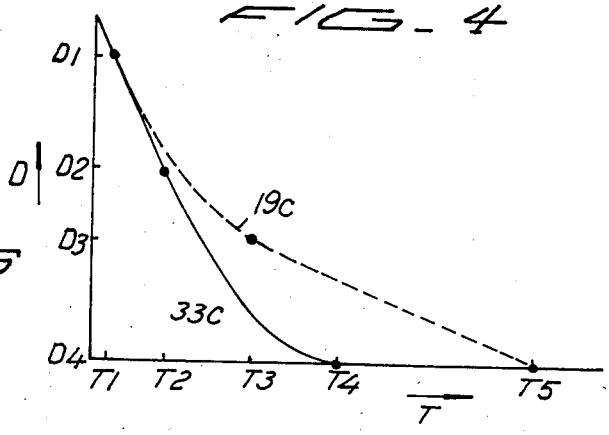

ELEVATOR BRAKE CONTROL METHOD AND ARRANGEMENT

BACKGROUND OF THE INVENTION

1. Field of the Invention

The present invention refers to a method and an electronic arrangement controlling the predetermined braking or deceleration, and particularly stoppage or detention, of motor driven mechanisms or moving bodies (mobiles).

More particularly, the present invention can be used for controlling the progressive braking of moving bodies or mechanisms i.e. mobiles, between certain points, in a minimum of operating time and with maximum efficiency, independently of initial, load and kinetic energy variations.

The present invention is applicable to uses such as controlling elevators, hoists, cranes, winches, transmission belts, electric motor driven vehicles, rolls or any other use in which it is required to precisely brake a mobile to reach a certain last point or position under certain conditions.

The present invention is specially applicable when the mobile is an elevator cabin, a crane boom, a transmission belt and in general, machine members which must efficiently translate between a plurality of positions, and stop precisely thereat.

The term "mobile" is used hereinafter to mean a vehicle or mechanism subjected to a certain movement between or through a set of points, positions or stations. The mobile is moved along a generally guided path, track or trajectory which includes at least one "control zone". This control zone is defined, in the present specification, as extending between a first or initial point and a destination, target or last point, inside which the mobile is controlled according to the present invention. It should be also understood that the movement referred to herein can be vertical, horizontal or oblique translation, rotation or combination of the same in relation to a certain mechanism.

2. Summary of the prior art

Electronic devices are progressively braking mobiles driven by electric motors and which must reach a certain speed and then attempt to smoothly stop in predetermined positions are known in the art. Such known arrangements requiere diverse types of elements such as electromechanical speed gauges and a series of mechanical, electromechanical, optical or magnetic sensors scaled along the movement path, to progressively send information referring to the relative position and speed of the mobiles. This progressive and variable information is transmitted through corresponding feedback loops that regulate the braking or deceleration energy applied to obtain the desired movement variations.

These arrangements are quite expensive due to the quantity, variety and type of their component elements, installation complexity, calibration and adjustment requirements, and for the same reason are prone to breakdowns, disadjustments or wear which call for frequent maintainance service.

In the known arrangements, the mobile speed is sensed, and as from a first point located a predetermined distance before the last point of the control zone, the sensed speed is compared at isochronal time intervals with a theoretical speed value predetermined as a time function, after which the necessary braking corrections are carried out. Consequently, these arrangements may not effect a constantly variable deceleration that assures the stoppage to occur exactly at the destination point. To overcome this problem, some time after braking is commenced and before the last point is reached, the mobile is progressibly slowed down to a minimum aproximation speed; after which it travels or "glides" more or less at this aproximation speed until it draws level with the destination (last) point where it activates the sensor which causes the mobile to be stopped. In this arrangement, this sensor is a must to indicate that the mobile has reached its final destination point.

The distance along which the mobile "glides" depends on the instantaneous work conditions, which in turn depend on the different loads and kinetic energy which must be neutralized. Consequently, considerable time is wasted when moving from one point to another, in particular due to the portion where the mobile "glides" at approximation speed. This is a distinct disadvantage in most cases which require faster speed of operation; i.e. minimum travel time, with maximum security and comfort factors.

SUMMARY OF THE PRESENT INVENTION

The present invention provides an electronic arrangement which permits the cited disadvantages to be overcome. The present invention considerably simplifies and improves mobile braking techniques. Braking is carried out with high precision and optimum time and travel factors, by simply controlling the reversion of the rotation direction of the motor, on the basis of a single external reference (for each control zone) fixed in respect to each station in the mobile path or trajectory, and a single transducer (for each mobile) coupled to the driver motor.

The present invention provides a specified deceleration controlled as a function of the distance to the final destination point at which the mobile arrives with exactly null speed.

According to the present invention, the energy fed to the motor is regulated in a novel manner to provide a uniformly variable deceleration to the mobile, by providing floating reference points where the real deceleration is checked against the theoretical deceleration curve preestablished as a function of distance (space). This permits correcting the braking of the mobile with greater anticipation, in terms of the offset (error). This is distinct from the clasical known arrangements which establish fixed check points which do not give a direct and exact deceleration curve.

Therefore, one of the objects of the present invention is to optimize the displacement and speed variations of mobiles. More specifically, the object of the present invention is to optimize the braking of a mobile, reversing the rotation direction of the electric motor driving it.

Another object of the present invention is to provide an electronic arrangement for controlling motors, for decelerating and braking mobiles operating according to tight specifications, carrying out all operations with a maximum of security and efficiency.

A further object of the present invention is to minimize the braking time during deceleration time, whilst simultaneously maintaining a high factor of security and comfort.

Another object of the present invention is to control the deceleration of a mobile from a predetermined variable control function defined in the space domain.

A further object of the present invention is to provide an arrangement having sufficient flexibility so that said control function may be easily altered.

Another object of the present invention is to stop a mobile exactly at a predetermined position under a broad range of variable work conditions.

Another object of the present invention is to control the displacement of mobiles without surpassing maximum predetermined deceleration limits.

A specific object of the present invention is to completely eliminate the "approach time" in stopping an elevator at any floor.

A further object of the present invention is to provide an electronic arrangement to control specific movements of mobiles between a plurality of points, and needing only a single reference sensor (for each control zone) and a single electromechanical transducer (for each mobile).

A particular object of the present invention is to provide a special transducer in electronic arrangements, for controlling variable movements of a mobile.

Another object of the present invention is to provide a braking circuit arrangement in the form of an integral unit which may easily be added into existing mobile traction installations already in use, to attain the aforementioned objects.

To obtain these and other objects and advantages, the present invention provides an electronic arrangement for decelerating a mobile impelled by a traction motor and travelling along a predetermined path or trajectory having a reference where a braking operation is to begin, and which includes means responsive to the passage of the mobile by said reference. The motor is connected to the power supply network through direction and power control means responsive to an input control signal. The novel arrangement comprises sensors means responsive to the entry of the mobile into the control zone of the trajectory to activate the deceleration control; transducer means responsive to the rotation of said motor for outputting a first signal related to the progress of said mobile along its trajectory; means for obtaining a second signal indicative of the distance covered by said mobile inside the control zone; means for obtaining from said first signal a third signal indicative of a predetermined dynamic parameter, such as speed or instantaneous acceleration magnitude, related to the movement of the mobile along the predetermined trajectory; means defining a theoretical relationship between the predetermined dynamic parameter and the distance covered and which provide a fourth signal for controlling the dynamic parameter as a function of the second input signal, and means for comparing the third signal with the fourth signal to obtain said control signal for the power control means.

It is to be understood that although the present invention is applicable to other specific uses, as stated before, it is described and illustrated herein in relation to the control of an electric motor moving an elevator or a hoist in either one or other direction from and to predetermined points (i.e. floors, stations or positions).

The method of the present invention consists in using a reference such as time, frequency, etc. which is variable according to the speed of the mobile, to continually sense the distance covered by the latter in the control zone on the basis of the turns of the driver motor or the displacement of any other element whose movement is directly related to the progress of the mobile, to determine in this way at different points, which are floating with respect to time but fixed with respect to space (distance), the displacement speed of the mobile, and then carry out the necessary corrections of the decelerating power applied to the driver motor through conventional means, insuring that the mobile stops at an exact distance from where the braking commenced.

BRIEF DESCRIPTION OF THE DRAWINGS

FIGS. 1 to 5 are plots showing curves that illustrate the present invention, and which also show for comparativeness, the curves of a prior art technique.

DETAILED DESCRIPTION OF THE PREFERRED EMBODIMENTS

Figure 6:
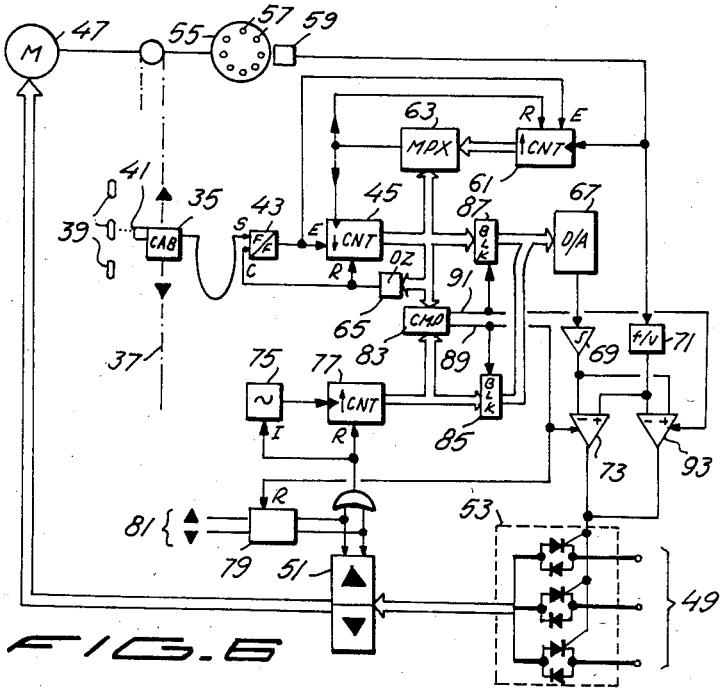
FIG. 6 shows an electronic arrangement according to a first embodiment of the present invention.

Referring to FIG. 1, the plot of speed V as a function of time T shows a probable natural tendency function curve 11, an ideal brake curve 13A and a real brake curve 15A corresponding to a prior art arrangement. The real curve 15A is below the tendency curve 11, whilst the desired ideal curve 13A is a straight line indicating constant deceleration of a specified magnitude, e.g. 1 $m/s^2$ for elevator cabins. However, it will be explained further on how the straightness of the curve 13A may vary.

The technical terms used in describing the present invention and its principal differences with the prior art arrangements, are defined hereinafter. In FIGS. 1 to 5, some reference numerals comprise a number with a letter suffix; the latter to distinguish different plots (in different figures) of the same function, i.e. speed V as a bidimensional function of distance D and time T (except FIG. 5). Hereinafter, the letter suffix is omitted when all are referred to.

Ideal brake curve or function 13: is established in a theoretical or empirical manner and represents a tradeoff between the minimum brake time, to optimize transport time of the mobile, and the maximum admissable deceleration, which depends on the application and which in general will be security in the case of moving objects and both comfort and security when transporting people.

Natural tendency curve 11: is determined point by point by the inertia conditions of the mobile along its trajectory due to the accummulated potential and/or kinetic energy.

Real brake curve or function and real displacement curve or signal: are determined from the actual displacement of the mobile.

Brake control curve or signal: is established by the electronic arrangement according to the ideal curve 13 for comparing with the real curve to obtain the sign and magnitude of the power corrections that must be effected in the mobile driver motor to make the real curve hug the ideal curve.

Automatically regulated braking devices, such as the invention considered herein, determine neccesary braking power corrections after comparing the real curve with the established control curve. Referring more specifically to these systems which reverse the direction of the driver motor to brake the mobile, the tendency curve 11 should always lie above the control curve (which is hugged by the real displacement curve because of feedback), because the deceleration is obtained through a retention efect caused by the reversed motor. If said relative position between these two curves is inverted, then it will be impossible to follow the ideal curve 13 without reaccelerating the mobile in such a case. If there were sufficient manoeuvre time, control could be regained further on by rereversing the motor to reaccelerate the mobile; however it must be considered that the smoothness condition must not be neglected, and the complications involved in providing a joltless reacceleration feature make such a system impractical.

In the prior art systems that brake by reversing the motor, the brake control curve is determined by preestablished relationship between speed and time which provides a fixed reference and with which the real brake curve is confronted with. The corrections are carried out at certain points in the path with an unavoidable time delay, resulting in the closeness between the real curve 15A and the idel curve 13A being a critical affair, because any excess braking power may carry the tendency curve 11 below the control curve 13A (which, as stated before, brings about loss of the deceleration control). On the other hand, if the brake power is insufficient, the real curve 15A draws nearer to the tendency curve 11 and away from the ideal curve 13A, resulting in the mobile surpassing the preestablished detention station (last point).

FIG. 2 is also a plot of speed V in the control zone, but as a function of the distance D from the last point, and where it should be noted that the ideal and real curves 13B, 15B are in correspondence with their respective curves 13A, 15A of FIG. 1. The tendency curve 11 has been omitted from FIG. 2 just for simplicity.

In practice, the real curves 15A, 15B vary within a certain range due to the load and kinetic energy conditions in action. It can be seen that the separation between the curves 13A and 15A (FIG. 1) offsets the travelled distance parameter, leading to a distance error 17 (FIG. 2) in the final stop position.

To avoid this error 17, the prior art incorporates an artifice illustrated with dashed lines in FIGS. 3 and 4, by means of which progressive braking is carried out until the mobile approaches the last point. When the mobile slows down to a very low speed, normally accepted as the minimum approach speed, this speed is maintained by reconnecting the motor at a very low rate in the forward direction during a certain distance which varies according to the different weights and/or kinetic energy neutralized during the slowing down stage. Finally, the mobile activates one or more reference sensors located in the final approach path to suddenly stop the mobile at the last point.

This artifice is clearly illustrated in FIGS. 3 and 4, where speed V is plotted against distance D and time T respectively. According to the function 19A, 19B (prior art) the mobile approaches at some constant speed V2 (depending on the instantaneous work conditions), and upon passing by the position D1, the braking arrangement is activated so that the mobile is progressively braked as from instant T1 and up to instant T3. At instant T3 the mobile is a short distance D3 from its target. After D3, T3, the mobile "glides" at the approach speed V3, to be finally stoped in the position D4. The time interval insumed for the complete stoppage operation is T5−T1. This braking method produces a considerable lengthening of the travel time of the mobile; and in the cases where there are numerous successive detentions as in the case of a modern elevator, the summatory effect of the successive delays may not be admissible.

The fundamental difference between the present invention and the prior art, is that the control curve, in addition to also being predetermined from the ideal curve 13 (letter suffix omitted), is directly affected by the actual speed and distance covered by the mobile. Thus the control curve is exactly predeterminable in relation to the distance covered by the mobile during the deceleration trajectory; and is floating in relation to the time finally insumed in said deceleration. Furthermore, this form of operation has the peculiarity that the separation of the displacement curve from the control curve, when the mobile is moving too fast, brings forward (in terms of time) the verification between speed and distance on the control curve, thereby advancing the corrective action, in proportion to the magnitude of the offset. In a similar manner, the corrective action is retarded when the mobile is moving too slow. This gives rise to a previously unknown efficiency in similar arrangements, and in a way that only a single reference point is needed at the start of the control zone for the mobile to be stopped precisely at the established last point, after effecting a progressive and continually uniform deceleration.

The plots of FIGS. 1 and 2 show the result obtainable by means of the present novel method and arrangement. The curve 13B in FIG. 2 is the ideal braking curve for the mobile under consideration and the curve 21B is the actual displacement (real operation) curve of the mobile acted on according to the method of the present invention. The fact that the mobile is directly controlled in the space domain, assures that by the time reaches its final position, the speed and displacement parameters of the mobile have values 23 which are practically invariable with respect to the work conditions. In actual fact, the influence of these work conditions creates the area 25 between the curves 13B, 21B and produces a slight variation in the braking time. This variation is of little importance because the main object of the present invention is to stop the mobile in an exact position, whereas small variations in the braking time in respect to the ideal curve are irrevelant. Translating curve 21B to the graph of FIG. 1, where it is indicated as curve 21A, it can be seen that there will generally be a substantial difference 27 (in this case reduction) of the braking time in respect to the prior art.

It can also be seen from FIG. 1 that the initial displacement error in terms of space, due to the instant work conditions, is totally compensated for, because the area 29 closed in by curve 21A above curve 13A is equal to the area 31 closed in by curve 21A below curve 13A (wherein the areas enclosed by V×T curves denote distances).

FIG. 2 also shows how the path of the mobile in the control zone is partitioned into a set of segments L0, L1, L2 . . . L9, LA . . . LF, the length of which decreces monotoneously as the mobile approaches its destination 23.

In this case, the illustrated partition virtually corresponds to equal time intervals, and therefore, to equal speed variations due to the straight line property of the function 13A. However, the present invention is sufficiently flexible to allow the partition to be generally arbitrary, so much so that in some cases as seen further on, the function 13A (and therefore the function 33A) is made slightly curved to avoid an abrupt change in the time derivative of the speed $\partial V/\partial T$.

FIGS. 3 and 4 explain the braking operation in a comparative manner by means of the novel real curves 33 (A and B) shown. The initial speed of the mobile is V2 (which as stated before depends on the work conditions), and when the mobile passes by an external reference at D2, it enters the control zone D2–D4, i.e. the deceleration commences at the instant T2. The space or distance parameter D is permanently up-dated, resulting in that the mobile is completely stopped in the position D4 at some instant T4.

The plot of distance D against time T in FIG. 5 clearly shows the improvement produced by the present invention. The coordinates D1–D4 and T1–T4 correspond to those in FIGS. 3 and 4. The prior art function 19C is shown in dashed line whilst the function 33C of the present invention is shown as a full line. The initial slope of the curve 33C for $T<T2$ is the mobile's initial speed V2 which is variable within a limited range. During $T2<T<T4$, the deceleration force is applied to the mobile, in such a manner that in position D4 the slope of curve 33C is null, i.e. the mobile is completely at rest.

It is interesting to see how the variation of the work conditions affect the real displacement curve 21, when the method of the present invention is put into use. It is emphasized that the adaptability to the different work conditions is a very important attribute of the invention.

Tha main initial work conditions of the mobile are weight (potential energy) and speed V2 (kinetic energy) at the moment the deceleration process commences. In the case where the weight varies within a certain range whilst the initial speed V2 is approximately constant (such as the case of the elevator where the weight depends on the quantity and size of the passengers and has a negligable influence on the cabin speed V2), the portion of the curve 33C (FIG. 5) in the interval $T2<T<T4$ "accomodates" itself so that there are no singularities at either end D2, T2; D4, T4 of the control zone, always maintaining the slope V2 at the initial end V2,T2 and the null slope ($V=0$) at the final end D4, T4. In practice, T4 may suffer small variations which, as stated before, are rather unimportant. This "accommodation" of the deceleration function causes a change in the curvature of the function 21B whilst simultaneously maintaining its ends 34, 23 fixed, varying the area 25 corresponding to excess operations time (FIG. 2). The difference T5–T4 (FIG. 5) is the time gained using the method of the present invention in relation to the described prior art. In the case of variable speed V2, the "accommodation" effect is similar, with the exception that the initial slope of the curve 33C at D2, T2 (FIG. 5) and point 34 of curve 21B (FIG. 2) also varies.

The meaning of the expression "floating verification points" used beforehand in the present specification is now evident. The aforementioned "accommodation" causes the speed V at a given distance D from D2 to vary within certain limits, causing the length of the segments L0, L1, . . . LF (the ends of which define the verification points) to vary in terms of time. Consequently, the verification points are floating with respect to time and are determined step by step, contrary to prior art. It must be pointed out that this is a fundamental novelty in the art. It can easyly be proved that the length of the segments L0, L1 . . . LF translated to the plot of FIG. 1 (in other words, the lengths L0, L1 . . . LF in time units) vary in an inversely proportional manner with the speed of the mobile.

It is remarked that the plots shown in FIGS. 1 and 2 are drafted on a linear scale according to results obtained in practice. On the other hand, the plots of FIGS. 3, 4 and 5 are simple graphs generated with the assistance of a programmable calculator, to assist the preceding description.

Reference is now made in particular to FIG. 6, and to the specific elevator example. A cabin (i.e. mobile) 35 is illlustrated which is capable of displacing itself in either direction along the path or trajectory indicated in dotted lines 37. In correspondence with each floor stop (i.e. last point) of the cabin 35 there is a small screen 39 placed in the path 37, in a manner that it may activate a magnetic or optical sensor device 41 fixed to the cabin 35, when passing by a specific reference point before the floor stop.

Each screen 39 defines a reference point in relation to each last point (which in this specific case are the different floor levels), defined by the distance between D2 (reference) and D4 (final) (FIG. 5).

The sensor 41 is coupled to the set input terminal of flip-flop 43, the output of which is in turn connected to the enable input of a down counter 45 having binary coded outputs.

In addition, the cabin 35 is coupled in a conventional manner to a traction motor 47 connected to a three-phase electrical energy supply network 49 by means of a pair of switching devices 51. The latter are connected in parallel and in a manner which permit them to provide three-phase power of opposite sequencies from a conventional power control device 53 implemented through thyristors. Though unillustrated, there are conventional devices associated with the gate of the thyristors 53, for detecting the zero voltage crossing of the energy supply and for avoiding undue triggering. Furthermore, in spite of that reference is continually made to an electric motor, the present invention is not solely limited to this type of motor.

Coupled to the motor 47 there is a device for emitting pulses in synchronism with the movement of the cabin 35, formed by a rotary disc 55 having a certain quantity of holes 57 in a circle near its periphery. These holes are capable of successively engaging an optical reader 59 to issue an output pulse each time the disc 55 rotates a fraction of a turn due to the cabin 35 being displaced a certain segment or unit of distance. This particular application of the pulse emitter device 55, 57, 59 is absolutely novel in elevator, hoist, etc., control arrangements. On one hand, a plurality of synchronizer and position sensor devices used in the prior art are replaced; and on another hand a single device is used to provide two essential data in the present invention. As will be more evident further on, the reader 57 is not only used to obtain data indicative of the distance D covered by the cabin 35, which data is given by the active edge of the pulses, but is simultaneously also used to obtain data indicative of the instantaneous speed V of the mobile 35, on the basis of the frequency of the output pulses. The term "frequency" in relation to the pulses is to be liberally interpreted in the present specification insofar as that in actual fact it refers to the fundamental frequency of the pulse signal, i.e. the repetition rate of the same.

The reader 59 is connected to the pulse input of an upcounter device 61 having progressive outputs, e.g. hexadecimal. The term "progressive outputs" is used to mean that as the counter 61 goes counting, a single active signal progesses from one output line to another whilst the signals of the rest of the output lines are passive, e.g. similar to the Johnson code. In the case of the hexadecimal counter, there will be sixteen output lines.

The counter 61 includes a prescaler formed by a chain of counters to divide by a certain coefficient the rate of the signals outputted from reader 59. The counter 61 has an enable input connected to the flip-flop 43. The outputs from both counters 45, 61 are connected to a multiplexer 63, in such a way so as to output an active signal when the states of both counters 45, 61 coincide according to a certain condition, e.g. equal. For experts in the art, it will be evident that the multiplexer 63 may be replaced by a four-bit magnitude comparator, if the counter 61 is of the same type as counter 45 (e.g. both having binary coded outputs).

The output from the multiplexer 63 is connected to both the pulse input of counter 45 and the reset input of counter 61. The output from counter 45 is also connected to a zero detector circuit 65, comprised by a set of diodes connected to each output line from counter 45 and a pulldown resistor connected to ground.

The zero detector 65 outputs an active signal when the state of counter 45 is zero and it is connected to both the reset input of flip-flop 43 and the jam or preset input of counter 45.

The output from counter 45 is also connected to a digital-to-analogue converter 67 and the latter is connected to an integrator amplifier 69. The accuracy and speed requirements of the converter 67 are rather modest, for which reason it may be implemented simply with a conventional ladder resistor network; whilst the integrator 69 is configured by means of an operational amplifier and a feedback capacitor (not illustrated), as is well known in the art. There is also a discriminator device, in particular a frequency-to-voltage converter 71 connected directly to the reader 59, to output a signal proportional to the instantaneous speed of the cabin 35.

The output from both the integrator 69 and the converter 71 are connected to a differential amplifier 73 which feeds the control gate of the power device 53.

In many other applications apart from the present one directed to an elevator, it is desirable to provide means for, not only the decelerating the elevator in the described manner, but also to progressively accelerate it from a stop position up to a final speed. The present invention readily accommodates an acceleration control circuit which will control the elevator as it starts up or down from any one floor until it attains a final constant speed V2.

The acceleration control means comprise an oscillator 75 connected to the pulse input of an upcounter 77 having binary coded outputs. In combination with the arrangment, there is a relay 79 connected to the switching devices 51 and activated through respective controls 81 for going either up or down. The relay 79 controls both contactors 51 in phase opposition; and it is also connected to the inhibit input of the oscillator 75 and to the reset input to the counter 77.

The accessory circuit for controlling the acceleration is connected to the main portion of the arrangement by means of a magnitude comparator 83 and a blocking stage 85. The latter is also connected to the D/A converter 67, for which reason there is a second blocking stage 87 added between the counter 45 and the converter 67. The comparator 83 has its respective input side connected separately to the counters 45,47 to produce two active output signals; a first one through output terminal 89 when the state of counter 45 is greater than that of counter 77 and connected so as to activate the blockage in stage 85 and to enable the amplifier 73; and a second one through output terminal 91 when the state of the counter 45 is equal or greater than the state of counter 77 and connected so as to activate the blockage in stage 87 and to enable a second differential amplifier 93. The input and output terminals of amplifier 93 are connected in parallel and in phase opposition with amplifier 73, as is shown in FIG. 6.

It should be evident to those knowledgable in digitals techniques that the interconnection between the devices 45, 61 may be made in several different ways that attain similar results. For example, a single presetable counter, i.e. having variable magnitude, may be used to implement the counter 61 and the multiplexer 63. The presetable counter would have a set of input terminals through which the presetable magnitude may be coded for starting the countdown. In this alternative embodiment, this counter would activate an output upon reaching a zero state to decrement counter 45 and reset itself. The operation of this alternative embodiment is similar, the just mentioned set of input terminals being equivalent to the control terminals of multiplexer 63 and the single output terminal being equivalent to the output from the multiplexer 63.

Figure 7:
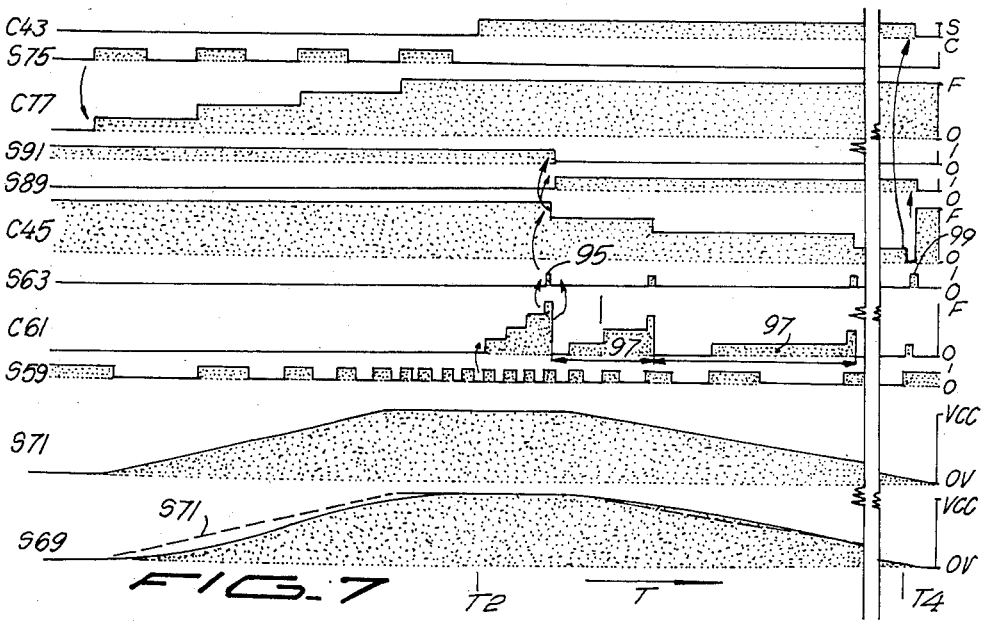
FIG. 7 is a time chart of the operation of the arrangement of FIG. 6.

The arrangement operates according to the following description, where reference is first made to the acceleration mode and then to the braking mode. The description is enhanced with the time chart in FIG. 7 showing the time dimension in an approximately linear scale advancing horizontally from left to right as indicated by arrow T, whilst the following variables are taken in ordinates:

C43: state of flip-flop 43, switching between "S" (set) and "C" (reset) states.

S75: output signal from oscillator 75.

C77,C45 and C61: respective count states of counter 77, 45 and 61, having a magnitude (length or capacity) to count between "0" (minimum) and "F" (maximum).

S91 and S89: mutually exclusive logic output signals from comparator 83 through terminals 91 and 89 respectively, which switch between the "0" (passive or false) and "1" (active or true) states.

S63: binary output signal from the multiplexer 63, switching between the logic states "0" and "1".

S59: Output pulses from reader 59.

S71 and S69: analogue output signals from the devices 71 and 69 respectively, ranging from "0V" to "VCC" voltage value.

A directive start signal produced by the control 81 is applied to relay 79 to place the arrangement in the acceleration mode. Apart from activating the inverter means 51, it starts up the oscillator 75 and enables the counter 77 which was previously reset to the state C77="0" due to the lack of this signal. The oscillator S75 begins to send clock pulses S75 at predetermined intervals to the counter 77 which has been arranged to count progressively and which, as previously explained, informs the comparator 83 of its count state C77. On the other side, the counter 45 informs its count state C45, which at this stage is at maximum "F" after the last deceleration cycle, to the comparator 83 where it is confronted with state C77.

Just so as to not complicate the drawing of FIG. 7, the states of the counters 45, 61 and 77 are illustrated in place of their respective output signals (of different weight or significance).

For the same reason, these counters are represented as having a magnitude of 4, however it must be remarked that generally this magnitude is insufficient for acceptable operation in the considered applications.

Upon the counter 77 receiving the first clock pulse S75 from the oscillator 75, it will climb to state C77="1". The comparator 83 has its output 91 activated so as to block the output from counter 45 by means of the signal S91 sent to the blocking circuit 87. Thus, only the state C77 of counter 77 reaches the set of A/D converter resistors 67 where it is converted to an analogue signal, passing to integrator 69 to feed output signal S69 to the noninverting input of the differential amplifier 93.

Meanwhile, the inverting input of amplifier 93 receives a voltage output signal from the f/V converter 71 which processes the pulses S59 issued by the electronic reader 59 in synchronism with the rotation of the driver motor 47. The output voltage V93 from the differential amplifier 93, applied to the gates of the thyristors 53, is:

$$V93 = G93 \times (V69 - V71)$$

where:

V69 is the reference voltage issued by integrator 69 proportional to the preestablished theoretical speed given by the function 13B (FIG. 2) transposed (because in the starting mode, the time parameter T travels in the opposite direction indicated in FIGS. 1 and 4), V71 is the voltage issued by the converter 71, proportional to the real displacement speed given by function 21B (FIG. 2) transposed, and G93 is the constant closed-loop voltage gain of the amplifier 93.

The differential amplifier 93 will be receiving a decreasing voltage via the integrator 69 caused by the regularly increasing state C77 of counter 77 due to the succession of pulses S75 outputed by oscillator 75. This will increase the output voltage from amplifier 93 which acts on the thyristors 53, to increase the speed of the mobile 35 until final speed V2 is reached. The cabin 35 then advances at this constant speed, until the hereinafter deceleration mode is entered.

When the arrangement receives a braking start signal from the reference plate 39 in the path 37 of cabin 35, the sensor 41 sets flip-flop 43 (C43="S"). This enables the counter 45 which is at its maximum count state (C45="F") since the previous accelerating process, ready for initiating the reference count-down. The flip-flop 43 also enables the counter 61 which is at state C61="0" since the last deceleration cycle.

The counter 61 then begins to receive pulses S59 from the electronic reader 59, and after a predetermined number of them, advances its state C61 step by step "0" to "F". This state C61 is confronted by multiplexer 63 with the coded reference value informed by the counter 45, and when they are equal, the multiplexer issues an active pulse 95 which is simultaneously received by the pulse input of counter 45 which decrements its state C45, and by the reset input of the counter 61, thus resetting it to C61="0".

This cycle is repeated while flip-flop 43 is set (C43="S"), and after each cycle 97 of counter 61, the state C45 of counter 45 decrements, until it finally reaches zero (C45="0"). This is detected by the diode gate 65 to reset the flip-flop 43 (C43="C"), to terminate the deceleration process (T=T4) and place the counter 45 at it maximum state C45="F". The counter 61 is left at state C61="0" by the last pulse 99 received from the multiplexer 63, to be ready for the next deceleration cycle.

During the deceleration process, the counter 77 is at its maximum state (C77="F") since the end of the proceeding accelerating cycle. As the deceleration cycle begins at T2, the counter 45 is also at its maximum state (C45="F"), for which reason the comparator 83 maintains its output 91 active. The active output 91 (due to C45=C77="F") activates the blocking circuit 87 and maintains the differential amplifier 93 enabled.

This situation will persist until the counter 45 receives its first pulse 95 from the multiplexer 83. After the count C45 is decremented, the comparator 83 issues an active signal S89 through it output 89, whilst cancelling the signal S91 at its outlet 91, thereby blocking the output from counter 77 and switching the relay 79. The relay 79 on one hand activates the direction inverter means 51 to place the motor 47 in a braking situation, regardless of the forward movement direction of cabin 35, and on the other hand to enable the differential amplifier 73 whilst blocking the differential amplifier 93. The output from counter 45 will then have exclusive passage to the converter 67, and from there to the integrator 69 where it is permanently integrated with respect to time, before entering the inverting input of the differential amplifier 73. At the same time, this amplifier 73 receives at its non-inverting input an increasing voltage 71 emitted by the f/V converter 71 which is processing the pulses S59 emitted by the electronic reader 59 solidary to the driver motor 47.

The output voltage V73 resulting from the differential amplifier V73 is given by the formula:

$$V73 = G73 \times (V71 - V69)$$

(where G73 is the constant closed-loop voltage gain of the amplifier 73). This voltage V73 controls in a conventional manner the triggering of the set 53 of thyristors and diodes, to regulate the power of traction motor 47, applied through the inverter devices 51.

The error signal outputted by the pair of amplifiers 73, 93 is positive, resulting in S69<S71 during acceleration and S71<S69 during braking. In FIG. 7, the function S71 is drawn in dashed line over the function S69. The amplifier 69 provides linearity for the curve S71.

The simplicity of the present invention, evident from FIGS. 6 and 7, is one of the many merits of the present invention, if one considers the sophisticated task it carries out. It should also be pointed out that the arrangement gives a correct, in fact optimal, response even when it receives a stop instruction during the acceleration mode, as is described in the following paragraph.

It should be remembered that during the acceleration mode C45="F" permanently whilst C77 is progressing upwards, resulting in that comparator 83 has its output 91 active. If at a given moment, the flip-flop 43 is set by a stop instruction from the cabin 35, the arrangement enters into both modes simultaneously, and the counter 45 begins to decrement step by step. However, the accelerating process carries on and the comparator 83 maintains its output 91 active (S91=1), blocking counter 45 through means 87 and enabling the amplifier 93, until the state of C45 of the counter 45 falls below that of counter 77. At this moment, the comparator 83 switches its output so that S81="1" and S91="0", causing the deceleration mode to prevail. It should be noted that the arrangement did not only respond adequately in the circumstance, but rather an optimal response was obtained in the sense that the time to reach the target D4 was minimized. This would obviously not have happened if the accelerating mode would have immediately been exited upon the flip-flop 43 being set.

The previous description regarding the novel method, physical arrangement and operation of the present invention is complemented hereinafter by explaining the functions carried out by the main components shown in FIG. 6.

The f/V converter 71 is for providing the signal indicative of the real displacement speed curve 21 (FIGS. (1 and 2) of the mobile 35; the counter 45 establishes the reference acceleration control curve 13B for each of the segments L0, L1 . . . LF (FIG. 2) in which the trajectory 37 of the mobile 35 is divided; the counter 61 integrates the pulse train supplied by the reader 59 for logging the progress of the mobile 35 in a certain segment L0, L1 . . . LF determined by the counter 45; the multiplexer 63 indicates whether the cabin 35 is passing through one of the check-points to up-date the data delivered by the counter 45 and reset the counter 61 to its initial state; the integrator 69 smooths the output control signal, in particular across the discountinuities between control values of adjacent segments; the comparator 83 decides the switching into either of the acceleration and deceleration modes; and the counter 77 provides the control curve for the positive acoeleration.

Figure 8:
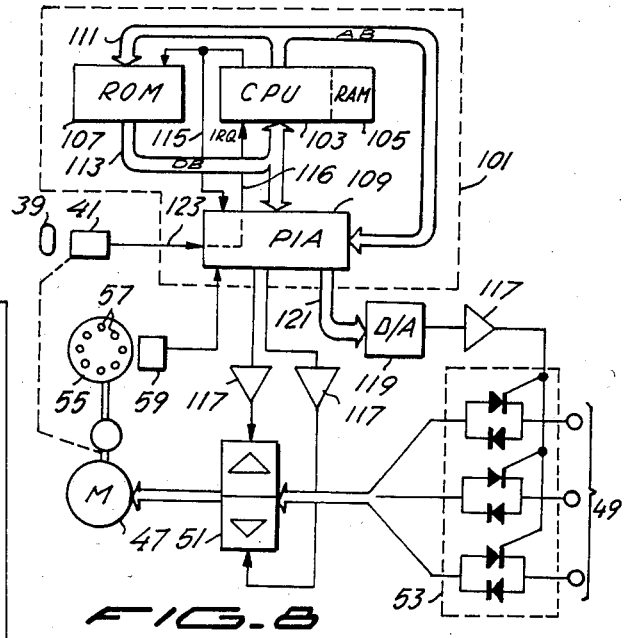
FIG. 8 shows the hardware of an arrangement according to a second embodiment of the present invention.

Notwithstanding the fact that the circuit of FIG. 6 implemented with discrete small scale integrated circuits is preferred at this time due to the cost and availability of its components and its ease of maintenance, we have also foreseen that the arrangement of the present invention may be implemented on the basis of a microprocessor, with the hardware illustrated in FIG. 8. This implementation is now described making reference to the deceleration mode, however those knowledable in the art will find that necessary additions to also carry out the acceleration mode are a relatively easy to determine.

DESCRIPTION OF AN ALTERNATIVE EMBODIMENT

A microprocessor unit 101 is shown in FIG. 8 comprised by its central processing unit (CPU) 103, a RAM or read/write memory 105 which may be integrated on the same chip as unit 103, a ROM 107 and an I/O port 109. These components of unit 101 are interconnected in a conventional manner through an address bus 111, a data bus 113, an interrupt request (IRQ) input line 116 and one or more control lines 115 (R/$\overline{W}$E).

A monitor programme for supervising the operation of the unit 101 and a routine dedicated to controlling the cabin deceleration process reside in the memory 107. This routine is simple and flexible and is schematically illustrated by the flow chart in FIG. 9. The RAM 105 has a portion assigned to the counter registers and another portion for storing status and flag signals as is explained further on; the bus 111 carries coded address signals to activate data transfer to the bus 113 between the CPU 113 and the ROM 107, the memory 107 (internally) and the I/O port 109. The latter connects the microprocessar unit 101 to the peripherals.

The I/O port 109 uses a peripheral interface adapter (PIA) having parallel output lines connecting to the peripherals. The latter comprises the aforementioned sensor 41, reader 59, reverse direction control 51 and power control 53 devices. The output lines towards the control devices 51,53 are provided with respective buffer and driver stages 117. The power control devices 53 is responsive to electric voltage values which are continually variable within a certain range, received through a single line for triggering the thyristors 53. The analogue thyristor triggering signal is obtained from the digital output line 121 via a digital to analogue (D/A) converter 119. The quantity of lines 121 depends on the maximum voltage step which is acceptable for proper operation of the power control devices 53.

The sensor 41 is connected through the IRQ line 116 to the CPU 103 through an input control line 123 of the I/O port 109; however is it also possible to connect it as a data input line to the port 109 which is periodically polled by the monitor programme. In the illustrated connection, when the mobile passes by the reference 39, the sensor 41 requests interruption of the microprocessor 101 for executing the following routine, described after the following variables and constants are defined:

VARIABLES:

Inputs

X41: Signal level inputted from sensor 41.
X59: Signal level inputted from reader 59.

Registers

F79: Mobile direction flag.
F59: Flag indicating the previous level of the reader signal.
C45: Control counter state.
C61: Displacement counter state.
C69: Integrator counter state.
C71: Mobile slowness register.

Outputs

Z53: Motor power control signal.
Z51: Motor direction control signal.

Constants

KDD: Displacement coefficient or unit.
K59: Prescaler coefficient.
F: Maximum counting capacity or magnitude of the counters.

The input and output variables are passed through the I/O port 109, whilst the registered variables are stored in the RAM 105 and the constants may be stored in the ROM 107 or in more flexible means such as digital switches (not illustrated).

Figure 9:
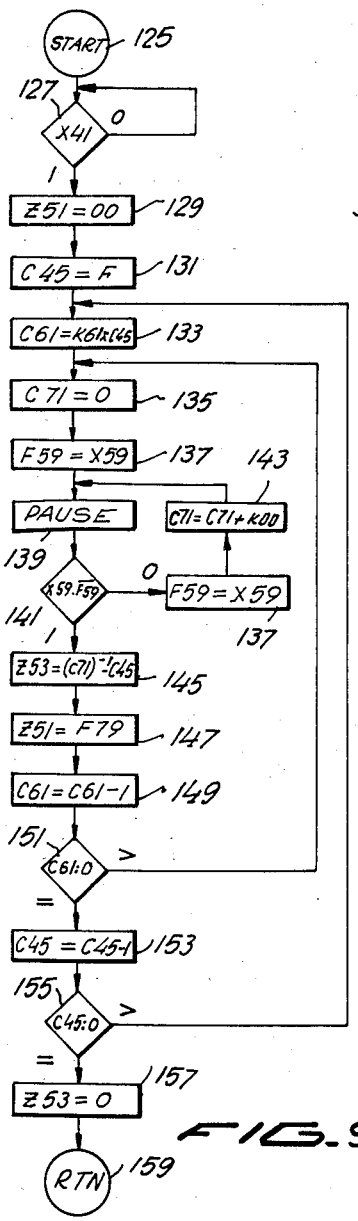
FIG. 9 is a flow chart associated with the operation of the arrangement of FIG. 8.

The following are the steps and remarks corresponding to the routine flow chart shown in FIG. 9:

125: Start of the deceleration control routine.
127: X41 Routine awaits triggering by the mobile 35 passing by the reference position D2.
129: Z51=00. Both contactors 51 are opened.
131: C45=F. The steps 131 to 135 are for initializing registers.

133: C61=K61×C45.

135: C71=0.

137: F59=X59. Prepares this register to be able to then detect the active edge of the pulse provided by the reader 59.

139: Pause. Fixes a time unit for the loop generated by the following step 141.

141: X59. $\overline{F59}$. Searches for the active edge of the signal X59 provided by the reader 59. Only when this is detected is the routine advanced, meanwhile the register C71 is updated.

143: C71=C71+KDD. This register measures the time lapsed between two successive active signals from the reader 59.

145: X53=INV(C71)−C45. Calculates the decelerating signal for the motor 47 by finding the actual speed of the mobile 35 given by the arithmetic inverse of the contents of register C71 from which the theoretical speed C45 is substracted. To carry out this arithmetic calculation which is mathematical notation is expressed by $(C71)^{-1}$, a corresponding subroutine may be added or otherwise a look-up table may be stored in the ROM 107. It must be assured that for any load condition, the real displacement curve 21 passes below the tendency curve 11; otherwise, it will be necessary to modify the displacement constant KDD.

147: Z51=$\overline{F79}$. Reverses the motor 47. The register F79 adopts one of the two-bit values 01 or 10 according to the original direction.

149: C61=C61−1. Updates the progress of the mobile 35 within the segment determined by the state C45 of the counter 45.

151: C61: 0? Check to see if the mobile 35 has reached the end of one of the segments L0, L1, . . . LE, LF (FIG. 2). If not, the routine goes back to repeat from the step 137 onwards.

153: C45=C45−1. The control speed is updated when the mobile 35 reaches the end of a segment.

155: C45:0? Check to see of the mobile 35 has reached its stop position D2 to terminate the routine.

157: C53=0. Theoretically this step is redundant, because during the last path through step 141, the value of Z53 should give zero. This step is included to compensate for any defect which may accumulate during the successive calculations.

159: End of the routine.

It should be noted that two portions of this routine may be distinguished: one defined by the inner loop formed by the steps 139, 141 and 143 operating in the time domain, and the other defined by the remaining steps operating in the space domain, according to one of the fundamental hypothesis of the present invention.

DESCRIPTION OF FURTHER ALTERNATIVES

Undoubtedly an expert in the art may find fit to introduce variations in the described arrangements, both in the one implemented with discrete integrated circuits as the one based on a microprocessor. The following variation is just one of them, and helps to illustrate the flexibility of the invention.

Figure 10:
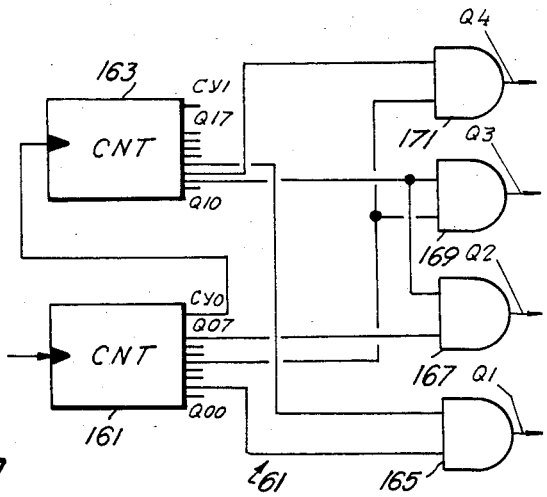
FIG. 10 shows in detail one of the components in FIG. 6, to illustrate a variation from the constant deceleration concept.

It was previously mentioned that curvatures could be inserted in the straight lines 13A (FIG. 1) and 33A (FIG. 4). This is desirable in the case of the elevator where, for reasons of comfort and security of the passengers, not only is the absolute magnitude of the deceleration limited, but also its time derivative (i.e. the third order derivative of translation with respect to time), so that the sudden effect of the decelerating force is not felt. Referring to FIG. 4, the vertices (V2, T2); (V=0, T4) of the curve 33A may be rounded off. As can be seen further on, these curvatures may have any length, up to the case where the interval T2<T<T4 of the curve 33A is solely comprised of two curve portions having opposite curvatures and joined at a single inflection point, without there being any straight line portion there between. As stated, the device 61 is comprised by a chain of counters. For clarity, FIG. 10 shows the device 61 comprised by only two cascaded octal counters: one counter 161 for counting units and the other counter 163 for counting octates. The pulse input of the counter 161 is connected to the reader 59, whilst the corresponding input of the counter 163 is connected to carry output (CIO) from counter 161. The outputs from both counters 161, 163 are multiplexed through logic and gates 165, 167, 169, 171 to form the output Q1, Q2, Q3, Q4 connected to multiplexer 63. As an example, the logic gates 165, 167, 169, 171 are connected to detect counts of "25", "15", "12" and "20" respectively. In this way, the counter 61 is prescaled with a predetermined dividing magnitude varying non-linearly as a function of the distance D.

The same variation may be easily implemented in the arrangement of FIG. 8. It suffices to reserve "F" words in the memory 107, for a table of values K61(C45). Then in step 133, instead of directly loading the constant K61, the state of register counter C45 is used to index addressing to the cited table.

We claim:

1. An electronic speed control arrangement for governing kinetic energy transfer means coupled to a mobile traveling along a guided path, said guided path including at least one control zone ending at a target location which said mobile must reach with predetermined speed by following a uniform deceleration pattern in said control zone regardless of the initial speed and potential energy with which said mobile enters said control zone, said control zone being partitioned into a plurality of segments of progressively decreasing spatial length and of approximately equal travel time according to said pattern; said speed control arrangement including sensor means responsive to entry of said mobile into said control zone to initiate deceleration of said mobile according to said pattern, transducer means responsive to movement of said mobile along said guided path to issue a pulse train having a repetition rate equal to the actual speed of said mobile, speed reference generator means connected to said transducer means to provide a reference speed signal as a predetermined function of the actual distance said mobile in said control zone is from said target location, and differential means for comparing said actual and reference speeds to obtain an error signal governing said transfer means; the improvement whereby said speed reference generator means comprise first counter means for receiving said pulse train from said transducer means to count pulses thereof and output an actual distance signal indicative of the progress of said mobile in one of said segments, counting capacity control means for uniformly decreasing the counting capacity of said first counter means each time said mobile reaches the end of a segment, and second counter means for counting a pulse each time the state of said first counter means reaches said counting capacity to output a uniformly decrementing reference speed signal towards said differential means, and to cause said counting capacity control means to vary the counting capacity of said first counter means according to the state of said second counter means.

2. The speed control arrangement of claim 1, wherein said magnitude control means comprises first comparator means connected to detect coincidence between the states of both said counter means to simultaneously send a resetting signal to said first counter means and a decrementing signal to said second counter means, thus fixing the counting capacity of said first counter means to the actual state of said second counter means.

3. The speed control arrangement of claim 2, wherein said first comparator means is a multiplexor device having its data and address inputs respectively connected to the outputs of said first and second counter means.

4. The speed control arrangement of claim 1, wherein said mobile is an elevator, and said target location is a selected floor stop.

5. The speed control arrangement of claim 4, further comprising a flip-flop device, and means for detecting a zero reference speed value due to said elevator reaching said floor stop to send a reset signal to said flip-flop device and presetting said second counter means for a next deceleration cycle, and wherein said flip-flop device is connected to be set by said reference sensor means when the elevator enters said control zone.

6. The speed control arrangement of claim 4, further including means for governing said mobile to follow a positive acceleration pattern, comprising a fixed time-base multivibrator, and third counter means receiving pulses therefrom to output a monotoneously increasing second reference speed signal to said differential means for governing starting and acceleration of said elevator from a floor stop until it reaches a predetermined speed after a predetermined time interval by providing the reference speed signal varying as a function of time.

7. The speed control arrangement of claim 6, further comprising second comparator means responsive to the states of said second and third counters to determine which one of these counters determines said reference speed signal, thus delaying deceleration of said elevator until said actual speed value is greater than said reference speed value.

8. The speed control arrangement of claim 1, wherein the output signal of said first counter means is passed through logic gate circuitry to selectively modify said deceleration pattern in one or more of said segments.

9. In a method for smoothly slowing and stopping an elevator at a predetermined floor level, said elevator traveling along a predetermined trajectory that takes it into a control zone beginning at a predefined entry point and ending at said floor level between which said elevator is slowed down following a generally uniform deceleration pattern based on the position of said elevator in said control zone without direct consideration to the time lapsed since said elevator passed said entry point; said method including the steps of partitioning said control zone into a plurality of segments of monotoneously decreasing spatial lengths corresponding to equal transit times at uniform deceleration, detecting passage of said elevator by said entry point, and thereafter monitoring the actual position and the actual speed value of said elevator in said control zone generating a pulse each time said elevator travels a predetermined constant distance not greater than the length of the last and smallest segment, thus producing a pulse train synchronous with elevator travel, generating a reference speed value from said actual position, and comparing said actual and reference speed values to produce an error signal for correcting the deceleration of said elevator; the improvement whereby said step of generating the reference speed value is effected by generating a series of linearly decrementing speed values, each decrement being responsive to said elevator passing out from one segment into the next adjacent segment, and making the reference speed value corresponding to each segment proportional to the spatial length of said segment by counting said pulses until a speed value equivalent to said reference speed value is reached, thus signaling passage of said elevator from a determined segment into the next adjacent segment at which point said reference speed value is decremented to the reference speed value corresponding to said next adjacent segment; and said comparing step comprising determining the equivalent difference between the actual repetition rate of said pulse train and said reference speed value.

* * * * *